US008720581B2

(12) United States Patent
Berg

(10) Patent No.: US 8,720,581 B2
(45) Date of Patent: May 13, 2014

(54) PRODUCTION MANIFOLD ACCESSORY

(75) Inventor: Geir Olav Berg, Jar (NO)

(73) Assignee: Aker Subsea AS, Lysaker (NO)

( * ) Notice: Subject to any disclaimer, the term of this patent is extended or adjusted under 35 U.S.C. 154(b) by 0 days.

(21) Appl. No.: 13/389,612

(22) PCT Filed: Sep. 24, 2010

(86) PCT No.: PCT/NO2010/000349

§ 371 (c)(1),
(2), (4) Date: Feb. 9, 2012

(87) PCT Pub. No.: WO2011/037478

PCT Pub. Date: Mar. 31, 2011

(65) Prior Publication Data

US 2012/0138306 A1 Jun. 7, 2012

(30) Foreign Application Priority Data

Sep. 25, 2009 (NO) ..... 20093063

(51) Int. Cl.
*E21B 43/017* (2006.01)

(52) U.S. Cl.
USPC ..... 166/344; 166/341; 166/366; 166/85.5; 285/132.1

(58) Field of Classification Search
USPC ..... 166/349, 338, 341, 344, 351, 360, 366, 166/368, 378–380, 85.5; 285/131.1, 132.1
See application file for complete search history.

(56) References Cited

U.S. PATENT DOCUMENTS 2,586,144 A * 2/1952 Benoit ..... 406/154
4,382,717 A * 5/1983 Morrill ..... 405/169
4,967,843 A * 11/1990 Corteville et al. ..... 166/366
5,435,338 A * 7/1995 Da Silva et al. ..... 137/242
5,437,302 A * 8/1995 Da Silva et al. ..... 137/242
5,857,715 A * 1/1999 Gray et al. ..... 285/131.1
6,142,708 A * 11/2000 Tarlton et al. ..... 405/170
6,148,921 A * 11/2000 Valla et al. ..... 166/344
6,182,761 B1 * 2/2001 Bednar ..... 166/339
6,352,114 B1 * 3/2002 Toalson et al. ..... 166/343
6,520,262 B2 * 2/2003 Barnett et al. ..... 166/367
6,997,645 B2 * 2/2006 von Trepka et al. ..... 405/170
7,086,807 B2 * 8/2006 Mackinnon ..... 405/170
7,112,009 B2 * 9/2006 Mackinnon ..... 405/173
7,533,732 B2 * 5/2009 Boyd ..... 166/385
7,537,052 B2 * 5/2009 Robichaux et al. ..... 166/193
7,841,394 B2 * 11/2010 McNeel et al. ..... 166/90.1
7,958,938 B2 * 6/2011 Crossley et al. ..... 166/366

(Continued)

OTHER PUBLICATIONS

Wikheim, Martin N., International Search Report for PCT/NO2010/000349, as mailed Dec. 17, 2010, 3 pages.

*Primary Examiner* — Matthew Buck
(74) *Attorney, Agent, or Firm* — Winstead PC

(57) ABSTRACT

A production flow base (1) for possible future branched connection onto a production manifold (10) in order to provide for the connection of at least two production jumpers extending from respective subsea Xmas trees onto the production manifold (10), is shown. The production flow base (1) is arranged as a retrofit module connectable to a single inboard hub (11) prearranged on the production manifold (10). The production flow base (1) includes a frame structure (2), piping (3), at least one connector (4) and guiding means (9). The frame structure (2) is arranged for landing on a supporting arrangement (12) projecting from a manifold structure (10). The piping (3) forms a branch terminating in a connector (4) and at least two outboard hubs (6).

8 Claims, 4 Drawing Sheets

(56) References Cited

U.S. PATENT DOCUMENTS

Figure 1:
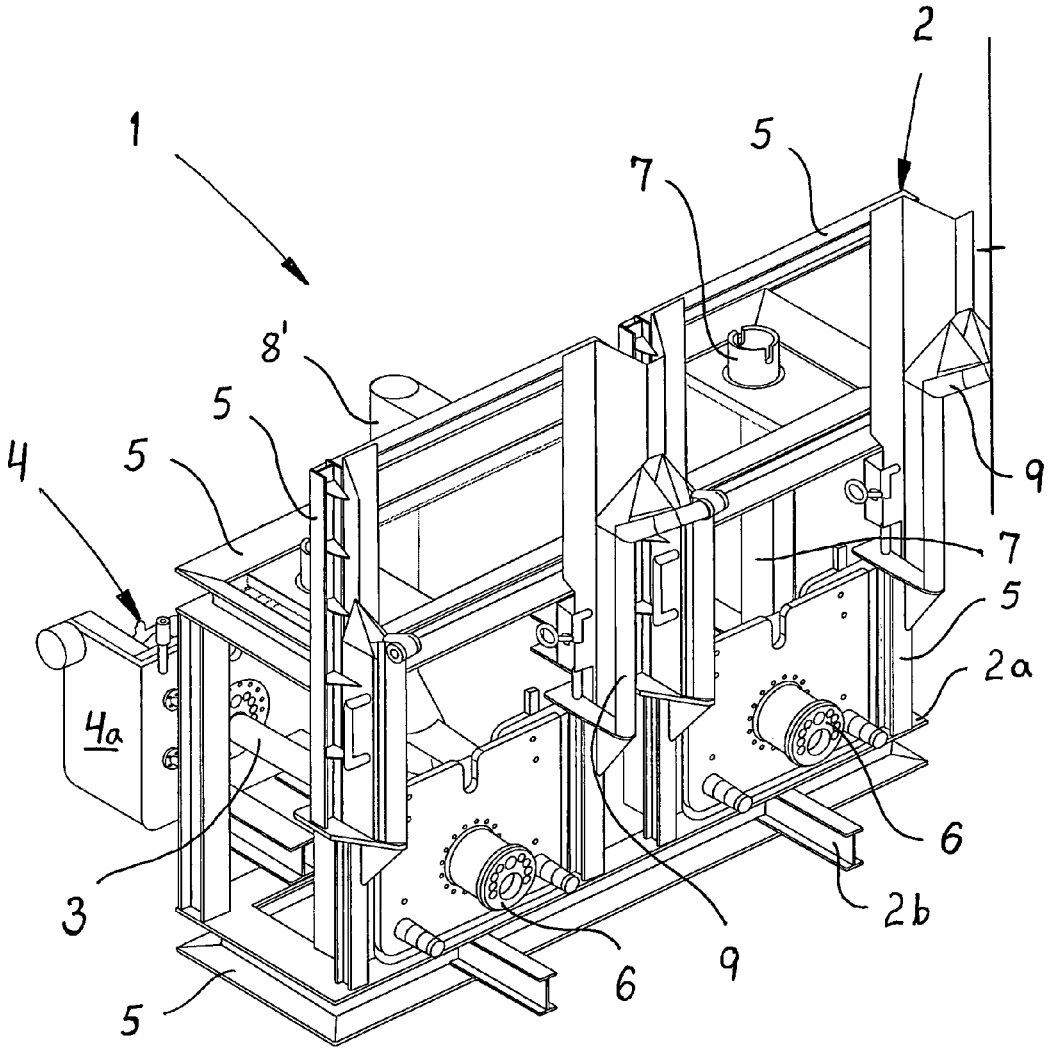

2003/0051880 A1* 3/2003 Hopper ..... 166/366
2007/0044972 A1* 3/2007 Roveri et al. ..... 166/367
2008/0223583 A1* 9/2008 Roveri et al. ..... 166/336
2008/0265567 A1* 10/2008 Morris ..... 285/131.1
2009/0025936 A1 1/2009 Donald et al.
2009/0314495 A1* 12/2009 Schott et al. ..... 166/366

* cited by examiner

PRODUCTION MANIFOLD ACCESSORY

The present invention relates to a production flow base for possible future branched connection onto a production manifold in order to provide for the connection of at least two production jumpers extending from respective subsea Xmas trees onto the production manifold.

Thus the present invention relates to a preparation for a potential increase in number of subsea production wells to be fluidly communicated to an existing subsea production manifold which is supported in a manifold foundation structure resting on the seabed.

In order to get such flexibility of adding additional branch connection on a subsea production manifold in the future, a production flow base (PFB) according to the present invention can be used. PFB will enable to connect two production Xmas Trees (XMT) to a single inboard GHO hub provided on the production manifold. Thus the production flow base can be considered as an accessory to the production manifold. Such kind of production manifold is disclosed in concurrently filed International Patent Application with title "Integrated Production manifold and Multiphase Pump Unit" having the same applicant as the present application.

A major benefit with using the production flow base according to the invention, opposed to a daisy chained solution (from an existing production XMT), is that the production flow base on the XMT can be left as is. A daisy chained solution will be dependent upon pulling the existing production flow base, including the production XMT, and thus result in increased rig time.

To complete the scope of equipment needed to connect a new well, an additional Xmas tree and associated jumper should be exercised. This includes electrical jumpers and multiphase flow meter.

The suggested production flow base piping and connectors provides for the connection from the two production jumpers onto the manifold. The piping is basically arranged in a Y-configuration and without any isolation valves.

In accordance with the present invention, a production flow base of the introductory said kind is provided, which is distinguished in that the production flow base is arranged as a retrofit module connectable to a single inboard hub prearranged on the production manifold, which production flow base includes a frame structure, piping, at least one connector and guiding means, said frame structure being arranged for landing on a supporting arrangement projecting from a manifold structure, which piping forms a branch terminating in a connector and at least two outboard hubs.

Preferably the manifold supporting arrangement is arranged as a levelling frame which together with said guiding means brings alignment between the connector and the manifold inboard hub during installation.

Preferably separate levelling means are included. Such levelling means may include screw jacks located on the production flow base and act against the levelling frame on the production manifold structure, which levelling means enables tilting adjustments.

In a preferred embodiment the piping branch may have the configuration of a Y-pipe.

Preferably the connector is facing the single inboard hub and the two outboard hubs are facing outwardly of the flow base and they are intended for connection of the respective jumpers.

The guiding means can be in the form of a tubular terminating in a funnel facing downwardly to mate with a complementary projection.

The guiding means may include guides arranged on the connector housing and mating guide pins on a fixation plate for the inboard hub.

The guiding means may also include guide rails for later landing of the jumper connectors during connection to the outboard hubs.

As one will observe, the PFB consists of two major assemblies:

1. Flow base Structural Assembly
2. Flow base Piping with Connectors

For the present solution the required multi-phase meter is kept on the production well jumper. The electrical power and signal jumpers are directly connected from the production well jumper onto the manifold and not via the production flow base. Tie-in tools used for the production flow base are the same as for the ordinary tie-in of a production well to the manifold.

Figure 2:
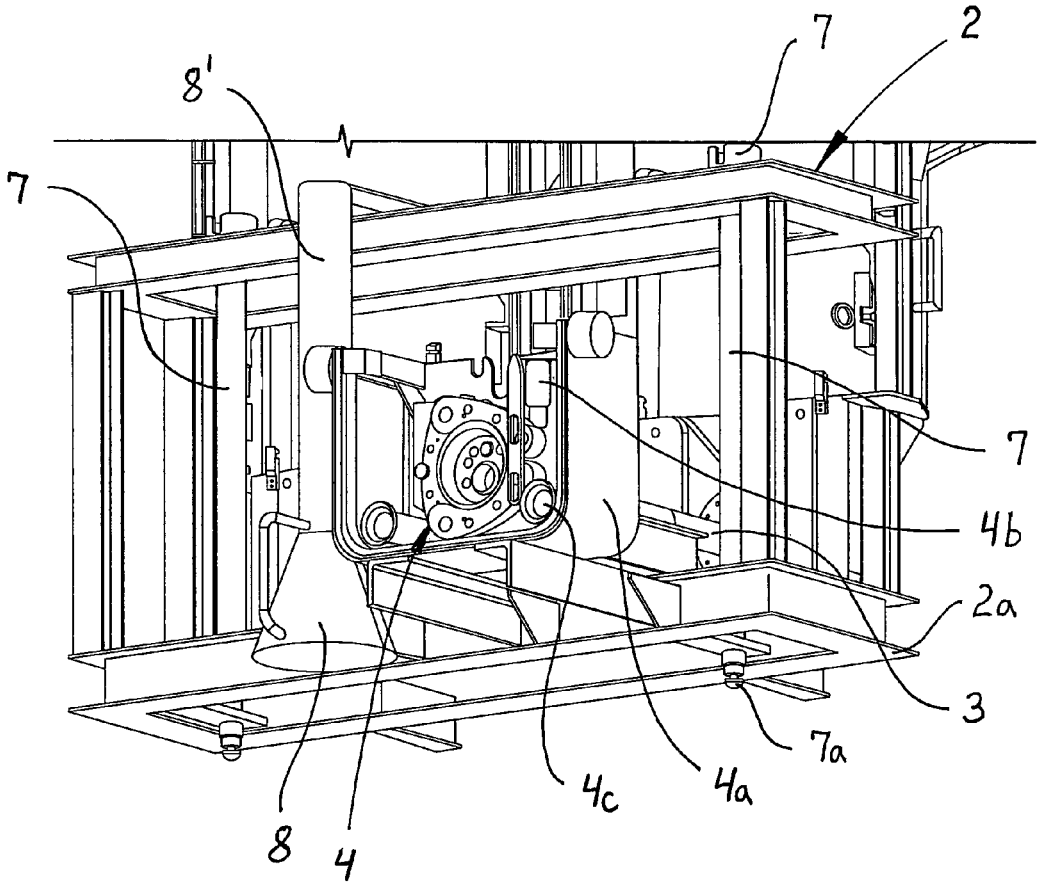
Figure 3:
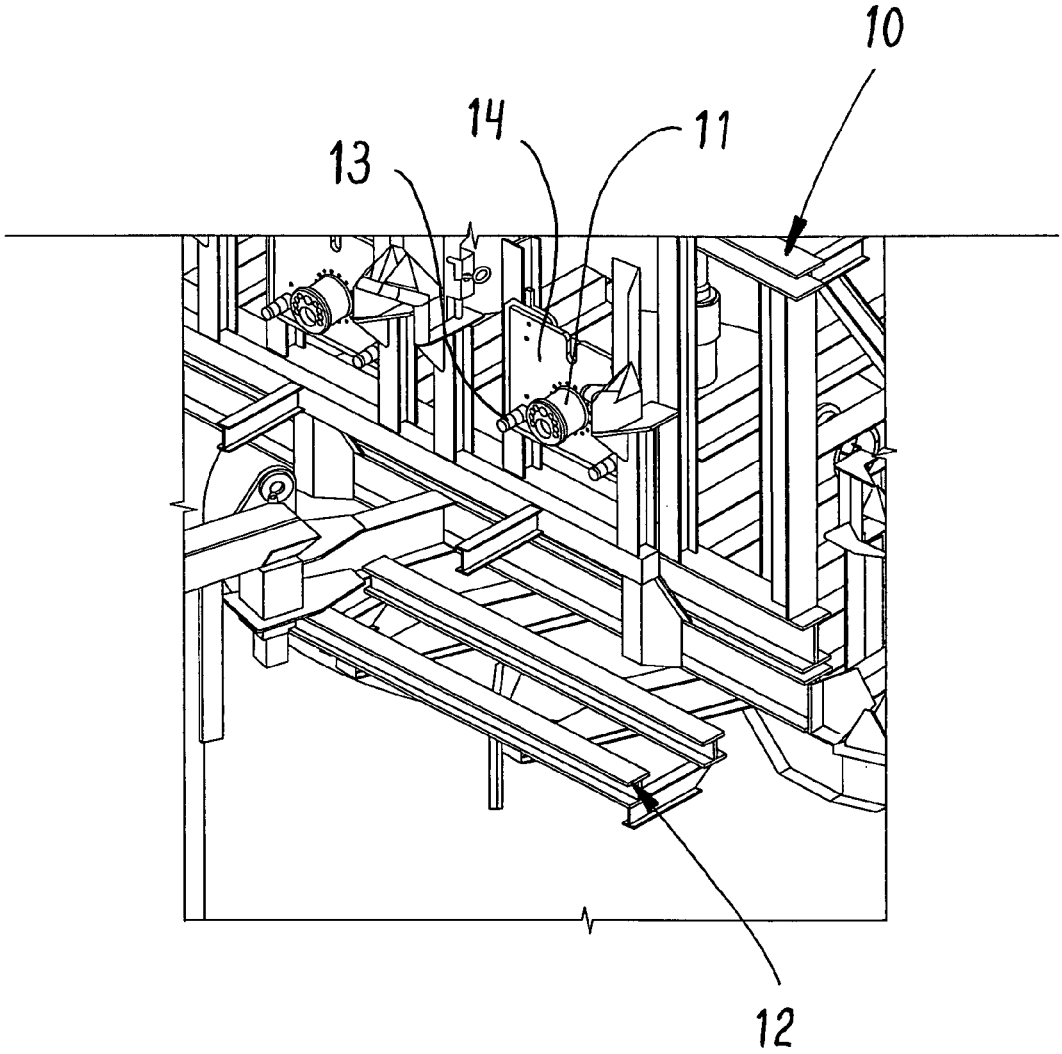
Figure 4:
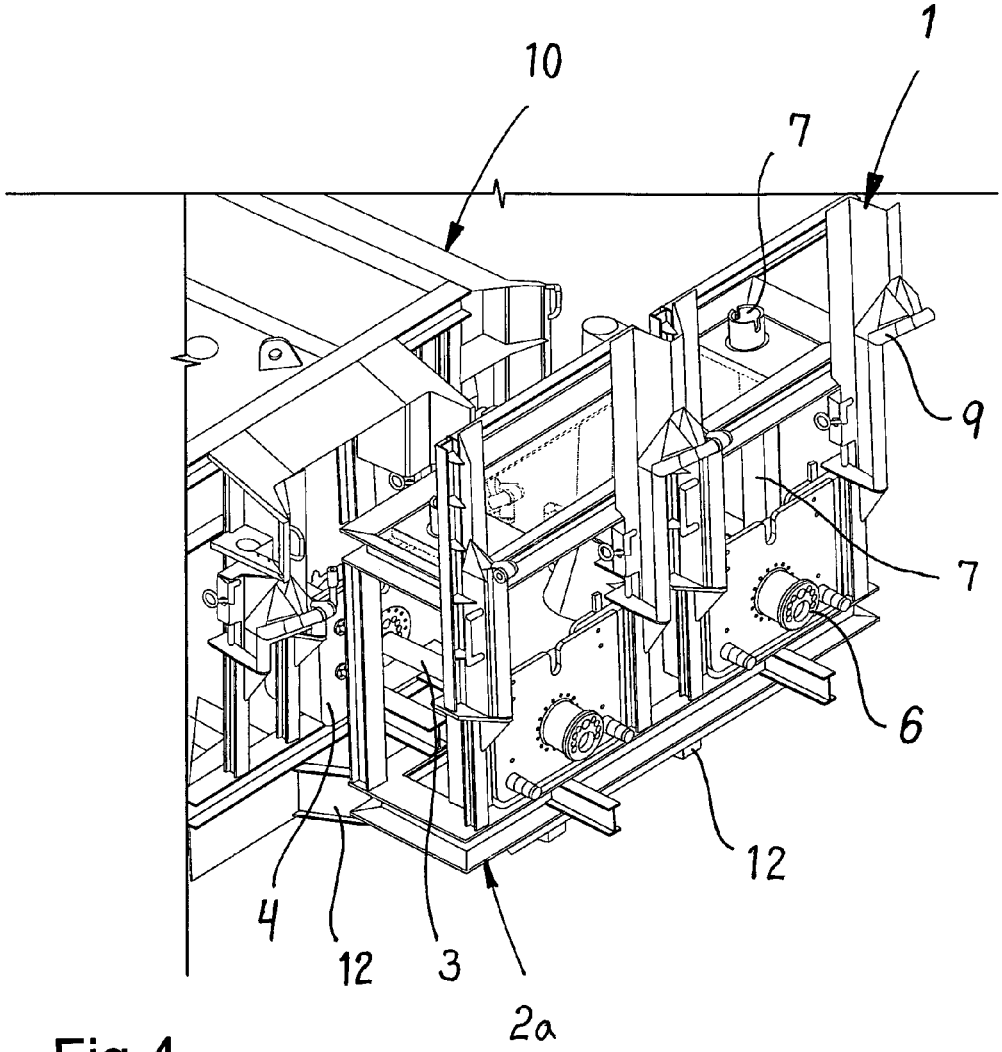

Other and further objects, features and advantages will appear from the following description of a preferred embodiment of the invention, which is given for the purpose of description, and given in context with the appended drawings where:

FIG. 1 shows an isometric front view of the production flow base according to the present invention, FIG. 2 shows an isomeric rear view of the production flow base according to the invention, FIG. 3 shows a part of a production manifold structure that includes the production flow base supporting arrangement and levelling frame FIG. 4 shows in perspective view the production flow base of FIG. 1 landed on the levelling frame shown in FIG. 3.

Reference is first made to FIGS. 1 and 2 showing the complete production flow base unit 1. As previously indicated, the production flow base unit 1 is composed of the flow base structural assembly 2 which in turn carries and supports the piping 3 and the connector(s) 4. The flow base structural assembly 2 also provides protection to the piping 3 and connectors 4 from possible dropped objects.

Before continuing with the detailed description of FIGS. 1 and 2, a brief description of FIGS. 3 and 4 will follow in order to better understand the use of the production flow base 1. FIG. 3 shows a partial view of a corner of a subsea production manifold 10. In general such manifold 10, which can be of different sizes and configurations, is in this context considered known by the person skilled in the art. As shown, the production manifold 10 includes several inboard hubs 11 prearranged on the production manifold 10. However, in this particular case, the production manifold 10 is additionally provided with a supporting arrangement 12 projecting from the production manifold 10 and being welded thereto as an integrated frame structure. This frame structure being the supporting arrangement 12 and will work as a levelling frame when the production flow base 1 is being landed thereon, as illustrated in FIG. 4.

Returning to FIGS. 1 and 2, the flow base structural assembly 2 is a frame structure constructed of steel bar profiles 5 of different cross section, though mainly I-beams, to obtain a rigid and stable structure. The flow base structural assembly 2 has a base frame 2*a* intended to rest on the levelling frame 12 on the manifold structure 10.

As previously indicated, the flow base structural assembly 2 supports the piping 3 which extend between two respective outboard hubs 6 and one single connector 4. Thus it is to, be understood that the piping 3 constitute kind of a Y-pipe, though this is not clearly shown in the figures. The two pipes extending from the respective outboard hubs 6 are merging and terminate in the one connector 4. How the pipes are routed through the flow base structural assembly 2 is of less importance. However, it is to be understood that the connector 4 is facing a single inboard hub 11 on the production manifold 10, while the two outboard hubs 6 are facing outwardly of the production flow base 1 and are intended for later connection of respective jumpers (not illustrated).

As illustrated in FIG. 2, the connector 4 is enclosed in a connector housing 4*a* giving protection to the connector 4 itself. The shown connector 4 is a standard clamp connector well suited for making up connection between flanged pipe ends. The clamp connector 4 is activated by a screw mechanism 4*b* which can be operated from above by an ROV. Further it is to be noted that near the corners of the connector housing 4*a*, locating apertures 4*c* are arranged. The locating apertures 4*c* assist during the aligning procedure when the connector 4 is to be mating with the inboard hub 11 on the production manifold 10.

The production flow base structural assembly 2 also supports levelling tools. Such levelling tools include two screw jacks 7 which are spaced apart some distance. The screw jacks 7 can be operated independently from above by an ROV. The screw of the screw jacks 7 acts against the levelling frame 12 on the manifold structure 10. Operation of the screw jacks 7 enables tilting adjustments of the entire production flow base 1.

As previously indicated, the production flow base 1 includes guiding means. One kind of guiding means is in the form of a tubular 8' terminating in a funnel 8 facing downwardly. Such funnel 8 is intended to mate with a complementary projection (not shown) provided on the manifold structure 10 for properly location.

Another kind of guiding means are the illustrated guide rails 9. The production flow base 1 is provided with such guide rails 9 which are designed for later landing of jumper connectors (not shown) during later connection of a jumper (not shown) to the respective outboard hubs 6. The base frame 2*a* also includes projecting stop bars 2*b* to constitute abutments for the jumper connectors.

Still another guiding means are guide pins 13 and guide apertures or guide cylinders 4*c*. As described, the production flow base 1 includes such guide apertures 4*c*, which are arranged within the connector housing 4*a*. The guide pins 13 are arranged on a fixation plate 14 for the inboard hub 11. The fixation plate 14 is in turn secured to the production manifold 10. The guide pins 13 are dedicated for mating in a guiding way within the guide cylinders 4*c* in the connector housing 4*a*.

Before such mating can take place, the production flow base 1 needs to be levelled relative to the production manifold 10, actually relative to the supporting arrangement in the form of the levelling frame 12. Such levelling, together with the guiding means, brings alignment between the connector 4 and the manifold inboard hub 11 during installation thereof.

Thus it is to be understood that the production flow base according to the invention makes possible future branched connection onto a production manifold. This provides for the connection of at least two production jumpers extending from respective subsea Xmas trees onto the production manifold. In order to obtain this, the production flow base is arranged as a retrofit module connectable to a single inboard hub prearranged on the manifold. Further, the production flow base includes a frame structure, piping, at least one connector and guiding means. The frame structure is prepared and arranged for landing on a supporting arrangement projecting from a production manifold framework. In turn, the piping forms a branch terminating in a connector and at least two outboard hubs.

The production flow base supporting arrangement 11 will ensure that the additional jumper loads are taken effectively by the production manifold foundation structure 10. For flexibility of installing the production flow base 1 on any hub, based on field requirements, its supporting arrangement is provided at all the four branch corner locations on the production manifold 10.

Provision is made in production manifold foundation for resisting vertical loads and other forces from maximum two numbers of flow bases. Foundation design loads considers that the production flow base will be installed at later stage of project, if required, after all the four branches starts production. In this scenario, jumper at any locations can be replaced with the production flow base for connecting two jumpers.

Scope of work for this operation includes the following for one of production manifold and levelling system.

Arrangement provided on production manifold levelling frame for receiving and supporting production flow bases at all the four branch locations.

Manufacturing of dummy production flow base required for FAT testing.

Necessary additional FAT testing during different fabrication stages to ensure smooth working of system.

Production flow base with tie-in equipment will be supplied separately as required.

The concept has assumed that, in case of the production flow base, both the connections are engaged with flow line jumper. In the case only one jumper is connected, then high pressure end cap is required on second connection hub.

The invention claimed is:

1. A production flow base comprising:

a branched connection onto a production manifold that provides connection of at least two production jumpers extending from respective subsea Xmas trees onto the production manifold;

wherein the production flow base is arranged as a retrofit module and the production flow base is connectable to a single inboard hub prearranged on the production manifold;

wherein the production flow base comprises:

a frame structure having a first connector connectable to the single inboard hub and at least two outboard hubs connectable to the at least two production jumpers;

branched piping extending from the at least two outboard hubs and terminating at the first connector, wherein the branched piping is located in the frame structure; and guiding means;

wherein the frame structure lands on a supporting arrangement projecting from the production manifold.

2. The production flow base according to claim 1, wherein said supporting arrangement is arranged as a levelling frame which together with the guiding means brings alignment between the first connector and the single inboard hub during installation.

3. The production flow base according to claim 1, comprising levelling means.

4. The production flow base according to claim 3, wherein the levelling means comprise screw jacks located on the production flow base, the screw jacks acting against the supporting arrangement on the manifold, which levelling means enables tilting adjustments.

5. The production flow base according to claim 1, wherein said branched piping forms a Y-pipe.

6. The production flow base according to claim 1, wherein the guiding means is in the form of a tubular terminating in a funnel facing downwardly to mate with a complementary projection.

7. The production flow base according to claim 1, wherein the guiding means include guides arranged on a connector housing and mating guide pins on a fixation plate for the single inboard hub.

8. The production flow base according to claim 1, wherein the guiding means include guide rails for later landing of jumper connectors during connection to said at least two outboard hubs.

* * * * *